US005954250A

United States Patent [19]

Hall et al.

[11] Patent Number: 5,954,250

[45] Date of Patent: Sep. 21, 1999

[54] HARNESSES

[75] Inventors: Maurice Van Hall; David Ian Middleton; Henri Schwegman, all of Northumberland; James Leslie McMillan, Kent; Ian Barrett, Northumberland, all of United Kingdom

[73] Assignee: Draeger Limited, Blyth, United Kingdom

[21] Appl. No.: 09/119,353

[22] Filed: Jul. 20, 1998

Related U.S. Application Data

[62] Division of application No. 08/658,850, May 31, 1996, abandoned.

[51] Int. Cl.[6] ..... A45F 3/00

[52] U.S. Cl. ..... 224/262; 224/271; 224/629; 224/632; 224/634; 224/645

[58] Field of Search ..... 224/583, 148.1, 224/148.7, 627, 628, 629, 631, 632, 633, 634, 637, 645, 660, 662, 663, 664, 259, 261, 262, 257, 271, 272, 148, 934

[56] References Cited

U.S. PATENT DOCUMENTS

| | | |
|---|---|---|
| D. 143,084 | 12/1945 | Littlefield et al. . |
| D. 143,097 | 12/1945 | Schneider . |
| D. 205,487 | 8/1966 | Goldwater et al. . |
| D. 231,571 | 4/1974 | Parker . |
| D. 233,741 | 11/1974 | Larhargoue . |
| D. 251,622 | 4/1979 | Garrison et al. . |
| D. 321,956 | 11/1991 | Williamson . |
| 903,682 | 11/1908 | Cumpston . |
| 1,637,635 | 8/1927 | Corley . |
| 2,844,145 | 1/1958 | Berge . |
| 2,975,439 | 3/1961 | Bentley . |
| 2,982,105 | 5/1961 | Akers . |
| 3,035,747 | 5/1962 | Ullrich, Jr. . |
| 3,355,075 | 11/1967 | Dean . |
| 3,957,183 | 5/1976 | Gadberry . |
| 4,015,759 | 4/1977 | Dreissigacker et al. . |
| 4,054,132 | 10/1977 | Deeds . |
| 4,062,356 | 12/1977 | Merrifield . |
| 4,214,685 | 7/1980 | Pletz . |
| 4,303,186 | 12/1981 | Ollinger, IV . |
| 4,310,110 | 1/1982 | Dexter . |
| 4,327,341 | 4/1982 | Richards . |
| 4,331,141 | 5/1982 | Pokhis . |
| 4,438,764 | 3/1984 | Eppolito . |
| 4,494,538 | 1/1985 | Ansite . |
| 4,526,298 | 7/1985 | Boxer et al. . |
| 4,582,054 | 4/1986 | Ferrer . |
| 4,739,913 | 4/1988 | Moore . |
| 4,911,346 | 3/1990 | Shallman . |
| 4,938,211 | 7/1990 | Takahashi et al. . |
| 5,046,492 | 9/1991 | Stackhouse et al. . |
| 5,184,763 | 2/1993 | Blaisdell et al. . |
| 5,188,267 | 2/1993 | Sargent et al. . |
| 5,203,325 | 4/1993 | Carr . |
| 5,243,972 | 9/1993 | Huang . |
| 5,361,955 | 11/1994 | Gregory . |
| 5,370,113 | 12/1994 | Parsons . |
| 5,400,943 | 3/1995 | Ducros . |
| 5,429,125 | 7/1995 | Wagner et al. . |
| 5,435,305 | 7/1995 | Rankin, Sr. . |
| 5,490,501 | 2/1996 | Crowley . |
| 5,492,110 | 2/1996 | Lenz et al. . |
| 5,503,314 | 4/1996 | Fiscus . |
| 5,609,278 | 3/1997 | Fresco . |

FOREIGN PATENT DOCUMENTS

| | | |
|---|---|---|
| 3417283 | 3/1985 | Germany . |
| 485203 | 5/1956 | Italy . |
| 618370 | 3/1965 | Italy . |
| 661235 | 3/1959 | United Kingdom . |
| 2059750 | 4/1981 | United Kingdom . |
| 2223930 | 4/1990 | United Kingdom . |
| 2275865 | 9/1994 | United Kingdom . |

*Primary Examiner*—Charles R. Eloshway
*Attorney, Agent, or Firm*—Emrich & Dithmar

[57] ABSTRACT

A harness to enable the wearer to carry an article such as breathing apparatus comprises a waist belt (9) carrying a waist plate (1) to which a back plate (21) is secured. The harness includes shoulder straps (20) and a coupling (41,50) for securing the article to it. The back plate (21) is moveable with respect to the waist plate (1) to facilitate movement of the wearer's body.

6 Claims, 20 Drawing Sheets

HARNESSES

Figure 1:
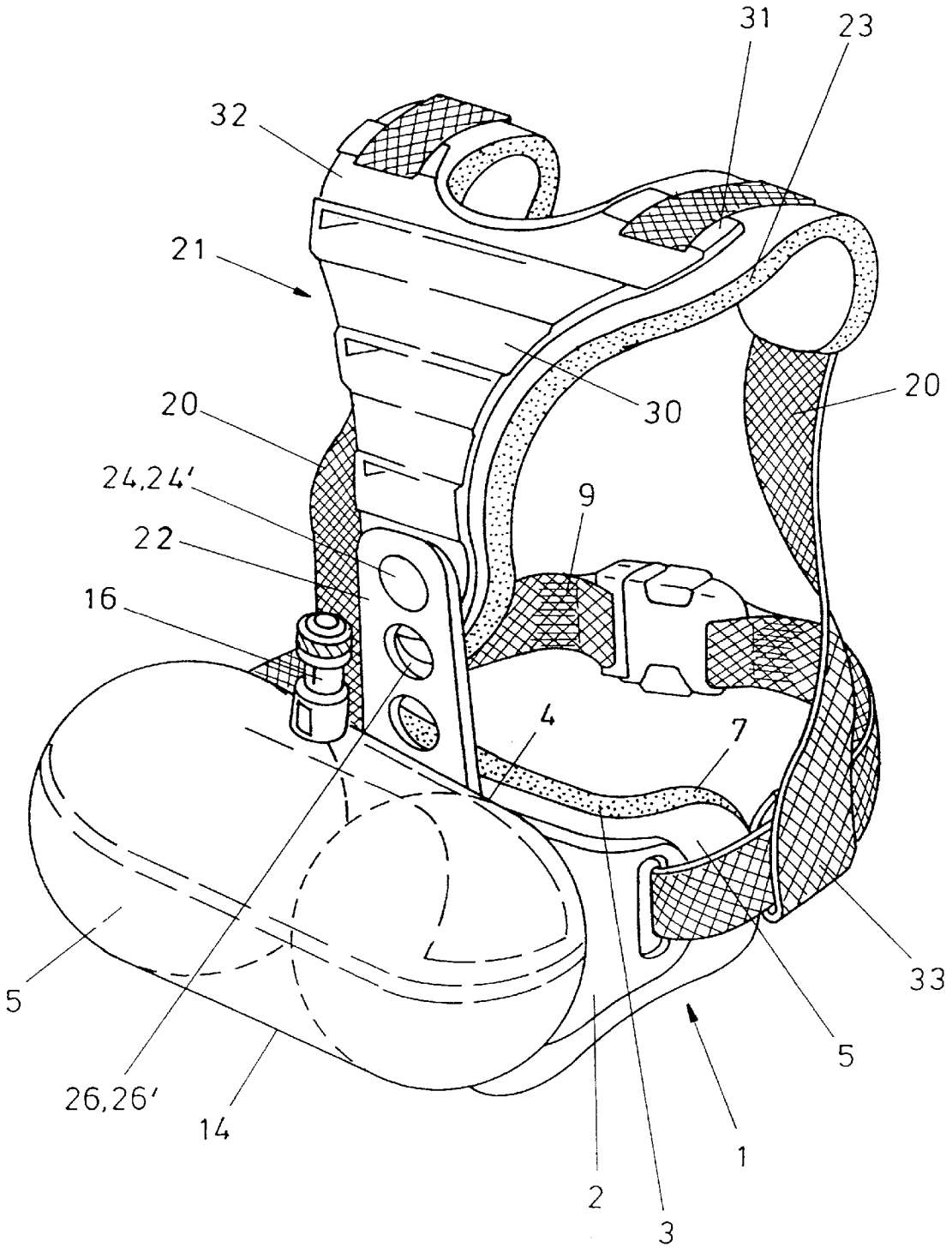

This is a division of application Ser. No. 08/658,850, filed May 31, 1996, now abandoned.

This invention relates to harnesses and more particularly, but not exclusively, is concerned with harnesses for securing breathing apparatus to the user of the apparatus.

Harnesses are known to enable articles, such as breathing apparatus, to be secured to the wearer of the harness to facilitate carrying the same. However, such conventional harnesses can be uncomfortable to wear particularly in cases where the article secured to the harness is heavy and/or bulky.

Moreover fire-fighters wearing breathing apparatus have to carry the weight of that equipment whilst carrying out a wide range of physical movements, often in extremely hostile environments. Also, there are other circumstances where people need to carry various articles by means of harnesses on the upper body. In order to reduce the potential for physiological strain in such circumstances, it is desirable to increase the mobility and manoeuvrability of the harness to enable the wearer to go through a wide range of movement without discomfort or distress.

The human body includes a number of joints which enable the bending of limbs and the torso. The major bending facility for the torso is in the spine, and particularly in the lumbar region. Harnesses comprising a rigid back plate held firmly in place between, and linking, shoulder straps and a waist plate thus restrict safe upper body flexing and bending.

It is an object of the present invention to provide a harness which enables heavy and/or bulky articles to be carried in a better position and with greater comfort and enhanced freedom of upper body movement.

Accordingly, the present invention provides a harness for securing an article such as breathing apparatus to the wearer of the harness, which harness comprises:

(i) a waist plate comprising a back portion and side portions, at each end of the back portion, for engaging the hips of the wearer, (ii) a waist belt, secured to the waist plate, for fastening around the waist of the wearer to hold the waist plate in position, (iii) a back plate moveable with respect to the waist plate and connected thereto, (iv) shoulder straps for looping around the shoulders of the wearer and connected to the back plate, and (v) a means of securing said article to the harness.

In an embodiment, the back plate is pivotally connected to the waist plate. More particularly, the back plate is pivotally mounted in an essentially vertical plane generally parallel to the wearer's back so that the back plate can pivot laterally with respect to the wearer. This greatly facilitates the ability of the wearer to lean to one side whilst wearing the harness.

Preferably, the back plate is flexible in a fore and aft direction (with respect to the normal direction of motion of the wearer) so that the wearer is more able to lean forward when wearing the harness.

In a particularly preferred embodiment, the back plate is movable with respect to the waist plate in such a way that the overall length of the waist plate and back plate can be varied i.e. such that the back plate can be moved vertically with respect to the waist plate.

In one form of this embodiment the back plate and the waist plate are connected together by a protrusion extending from one of the plates which is engaged in one of a plurality of apertures in the other of the plates. By suitably selecting an appropriate aperture to receive the protrusion, the overall length can be adjusted to enable the harness to be worn by persons of significantly different height.

In another form of this embodiment, the back plate and the waist plate are connected together by a protrusion extending from one of the plates which is engaged in an aperture in the form of a longitudinally extending slot in the other plate. The arrangement is such that the protrusion can slide along the slot in such a way that the overall length can vary during use to accommodate longitudinal movement of the spine of the wearer.

Generally, the lengths of the waist belt and/or the shoulder straps are adjustable to accommodate wearers of different sizes. Also, it is preferred for the waist belt and optionally the shoulder straps to be provided with quick release couplings to facilitate fitting and removing the harness.

Preferably the back plate is bifurcated at its upper end to form first and second limbs extending towards or to the shoulders of the wearer. In this case, one end of a first of the shoulder straps is secured to the first limb and one end of a second of the shoulder straps is secured to the second limb. This greatly lessens the risk of the shoulder straps slipping off the shoulders of the wearer as he moves about. Alternatively the tendency of the straps to slide off the shoulders can be reduced by arranging for the shoulder straps to cross one another prior to being passed over the shoulders of the wearer.

It is particularly preferred for the waist plate to include a connector plate whereby the article to be carried can he readily and releasably attached to the harness.

Figure 2:
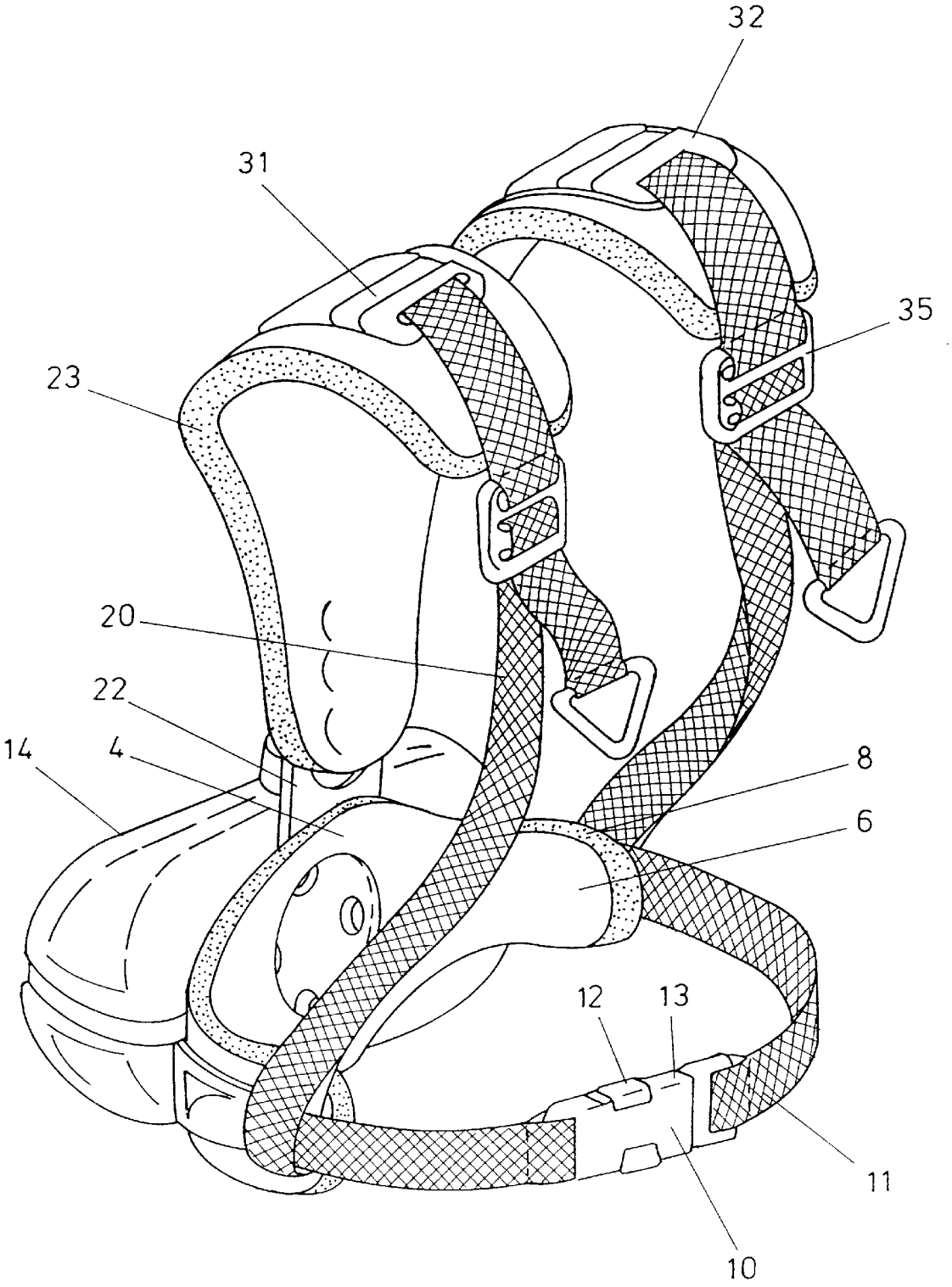
Figures 3, 4:
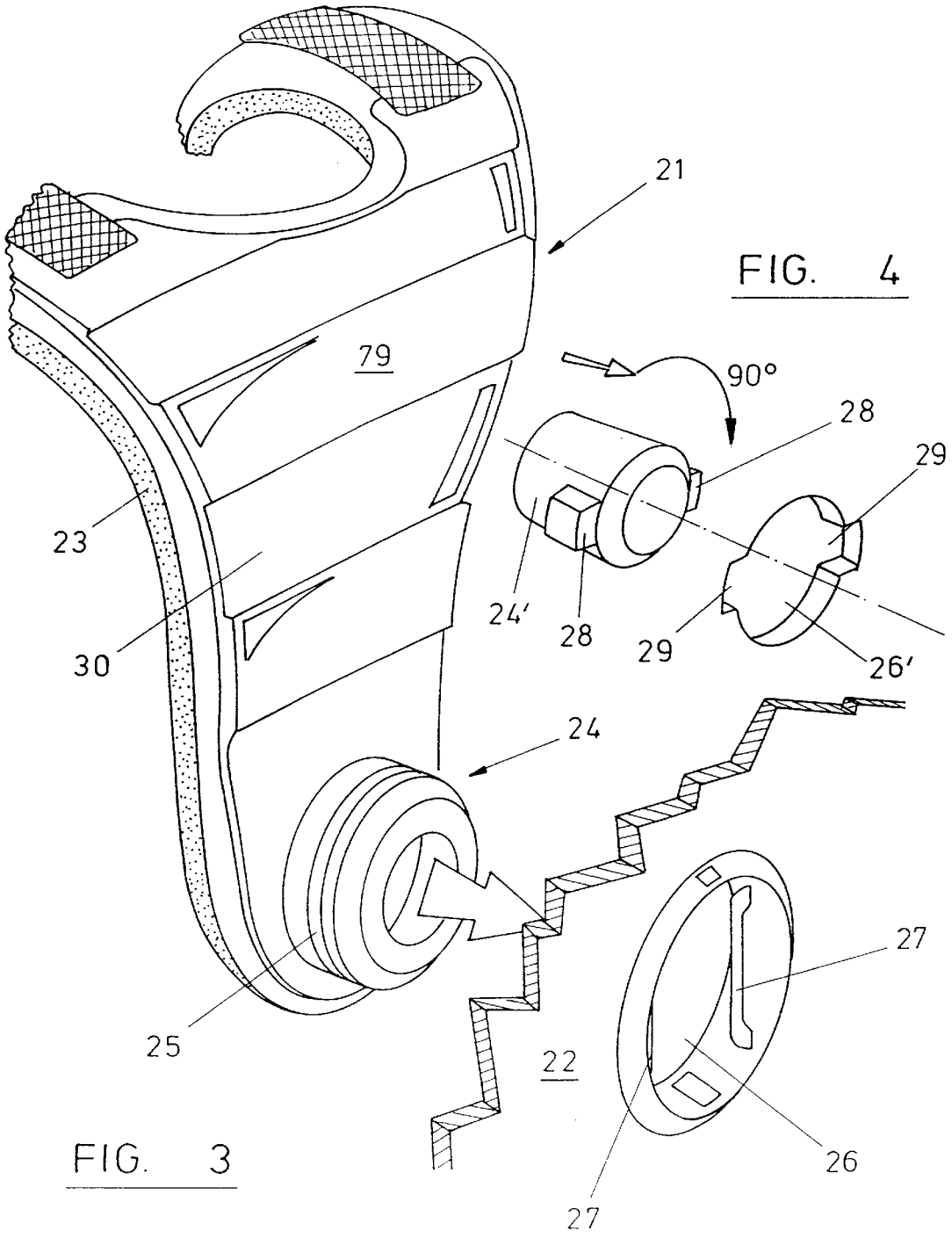
Figure 5:
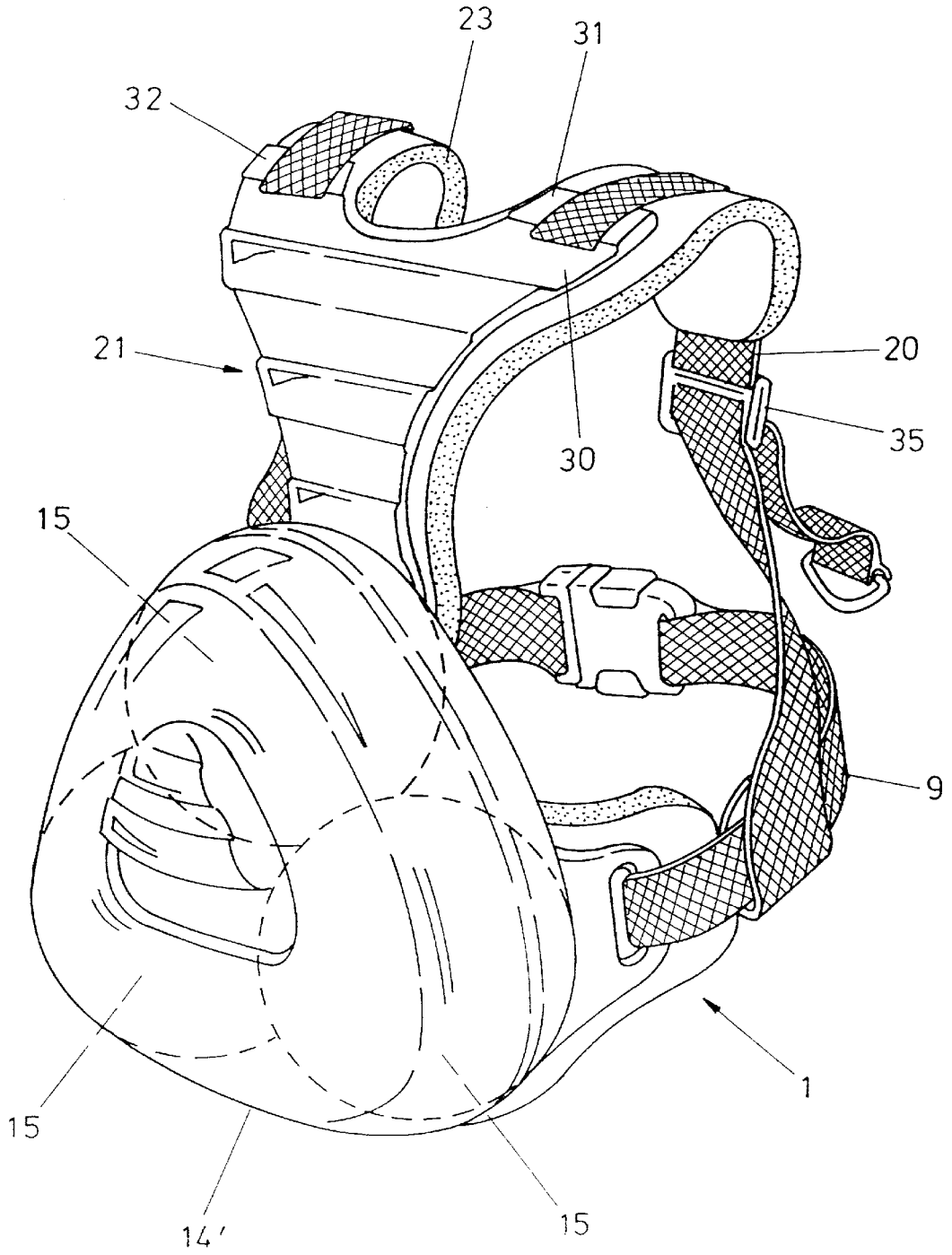
Figure 7:
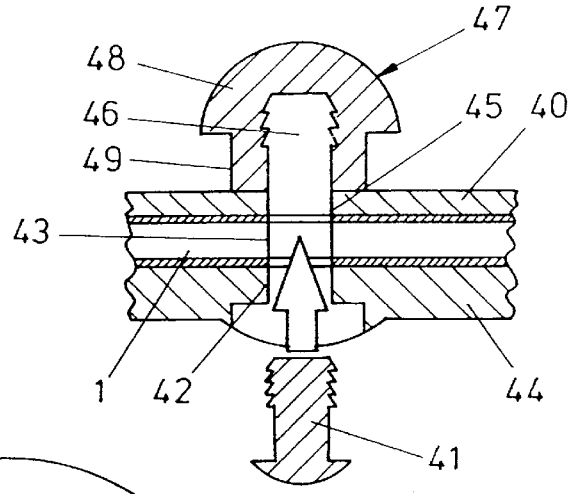
Figure 6:
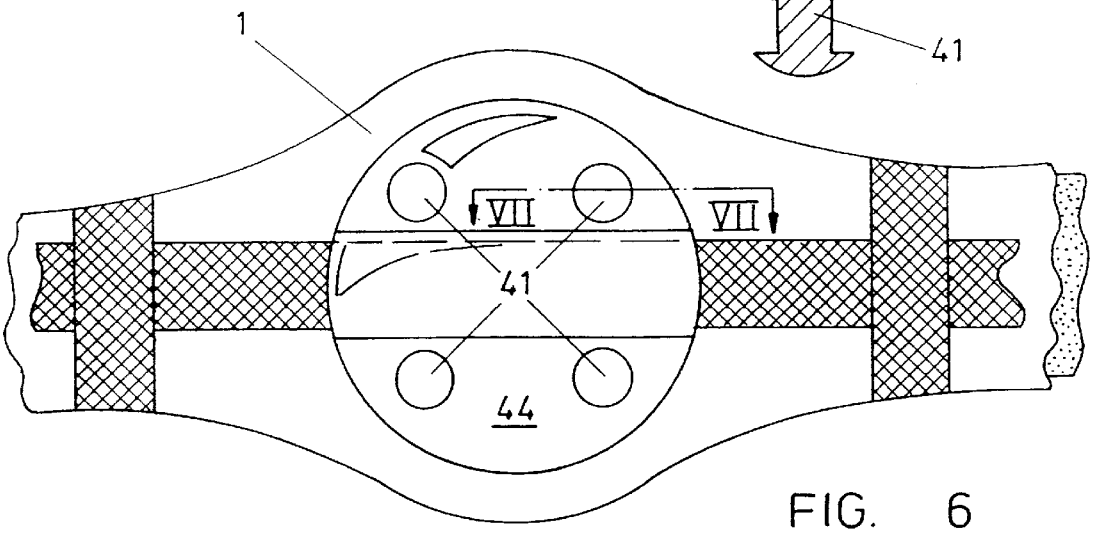
Figure 8:
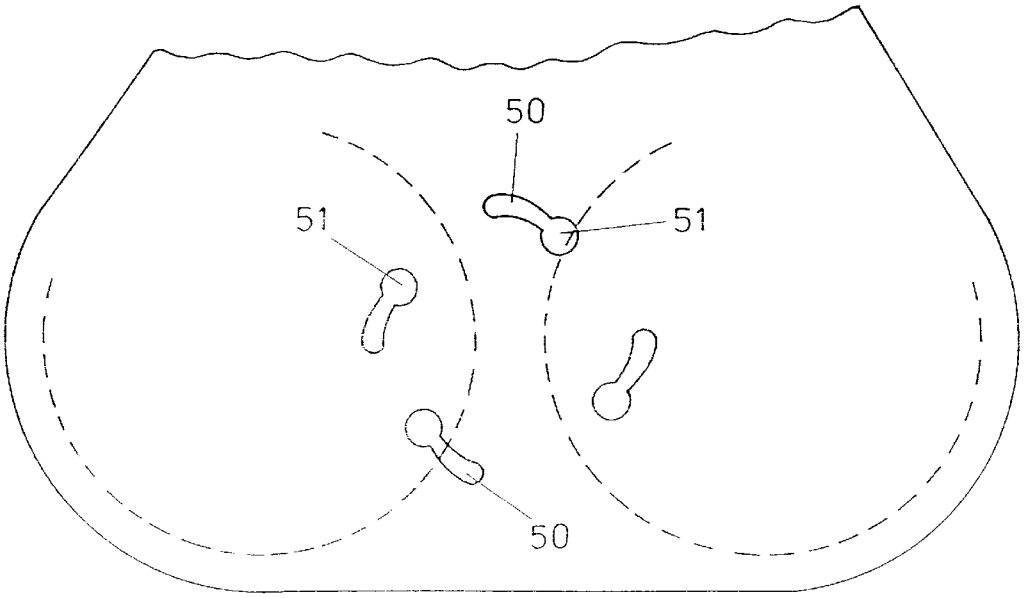
Figure 9:
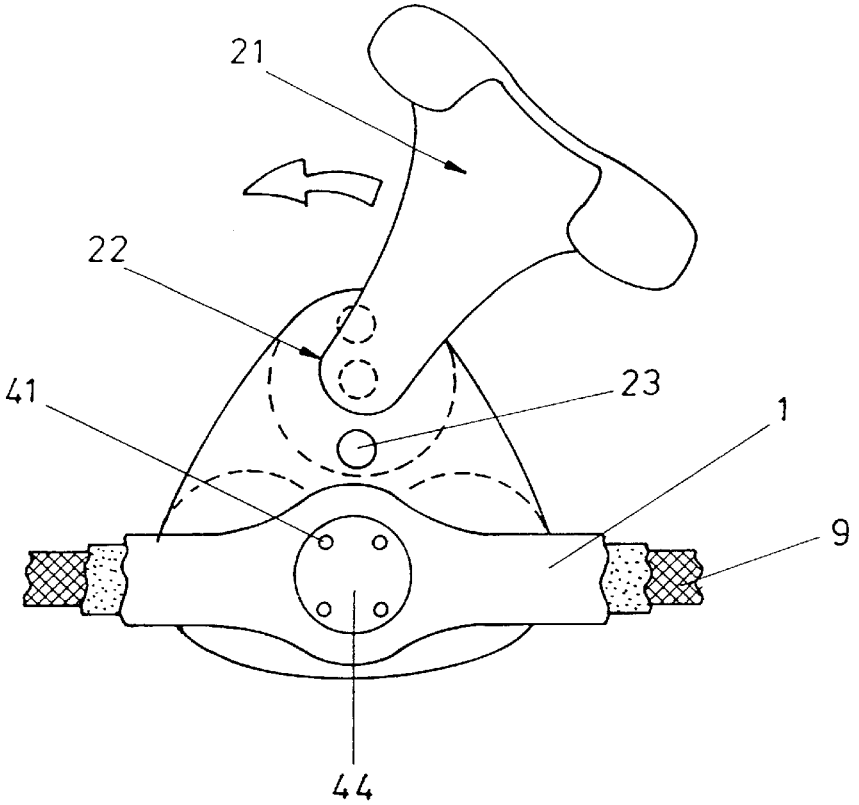
Figure 10:
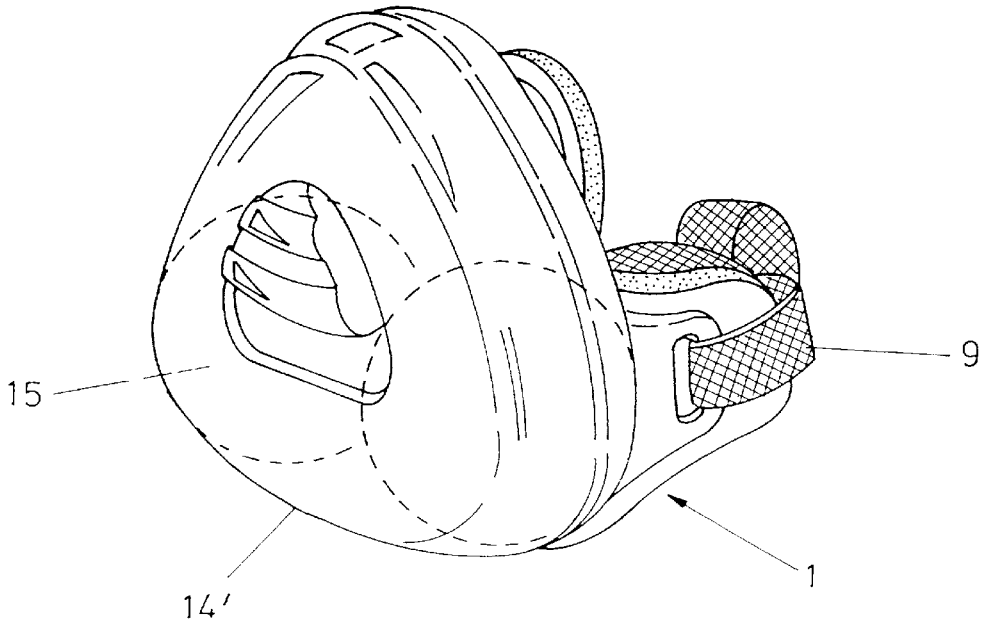
Figure 12:
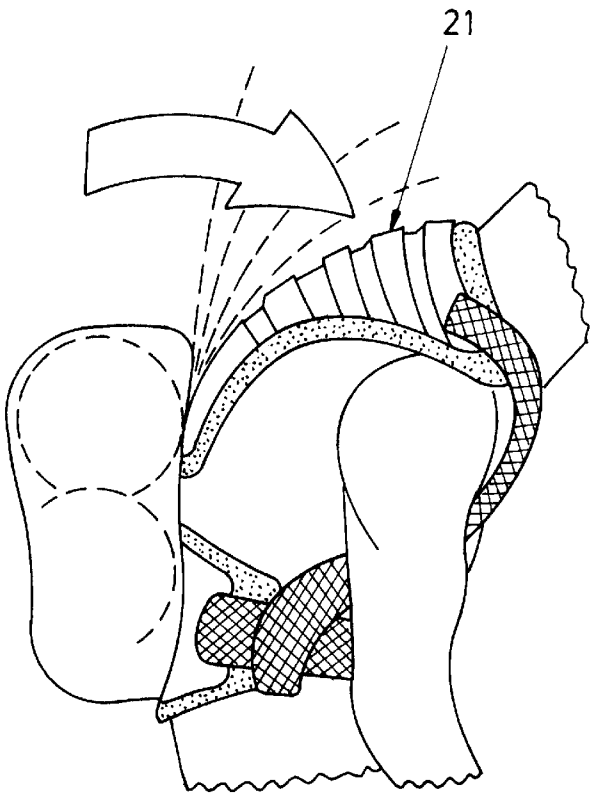
Figure 11:
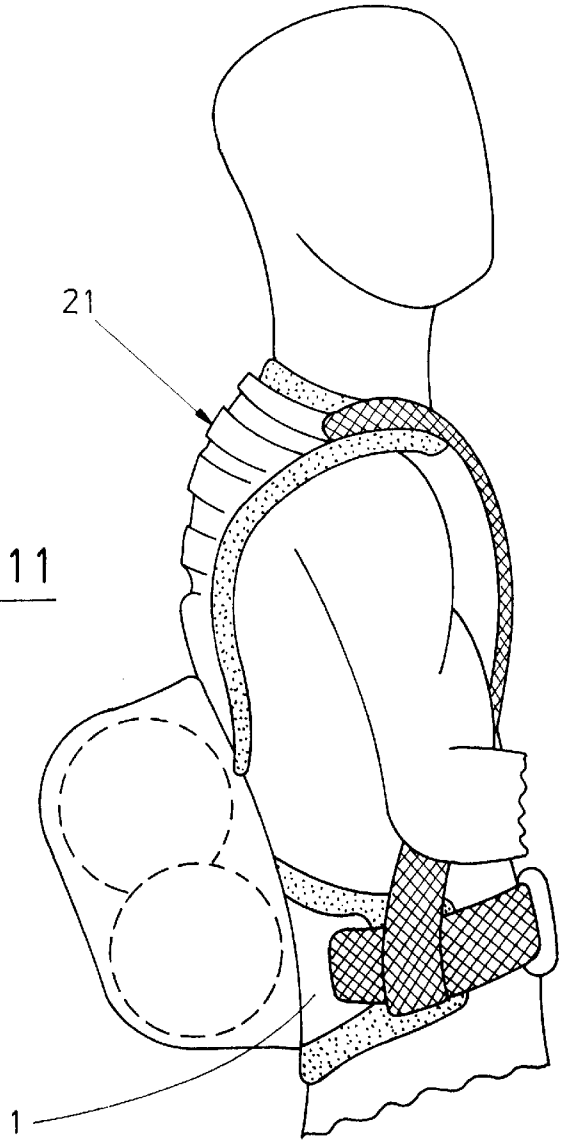
Figure 14:
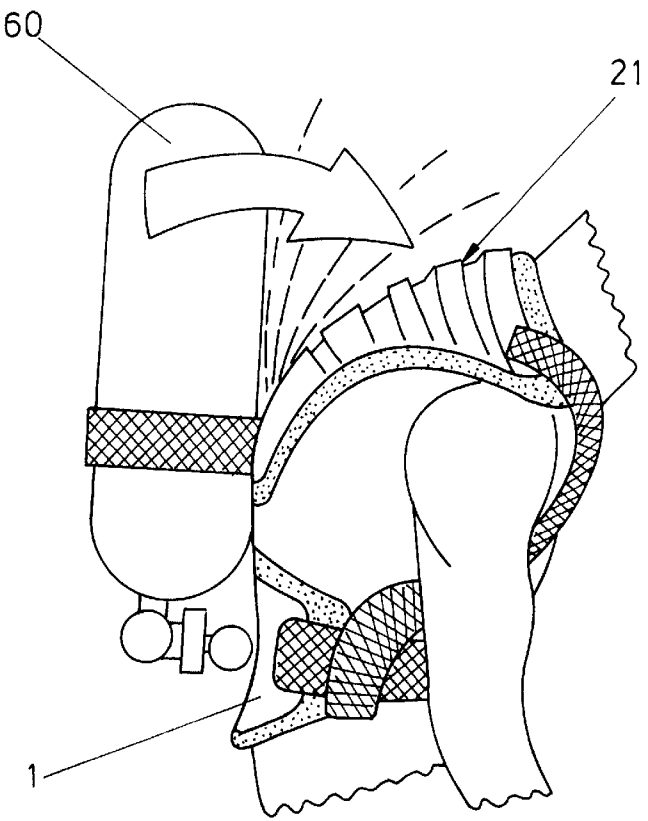
Figure 13:
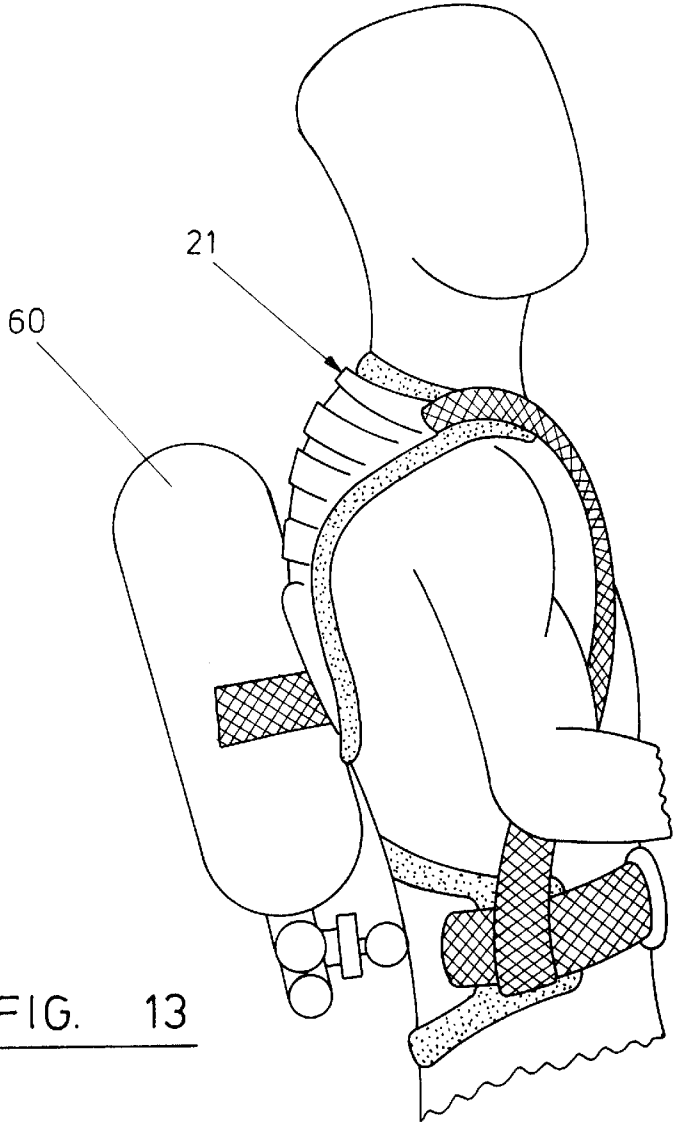
Figure 15:
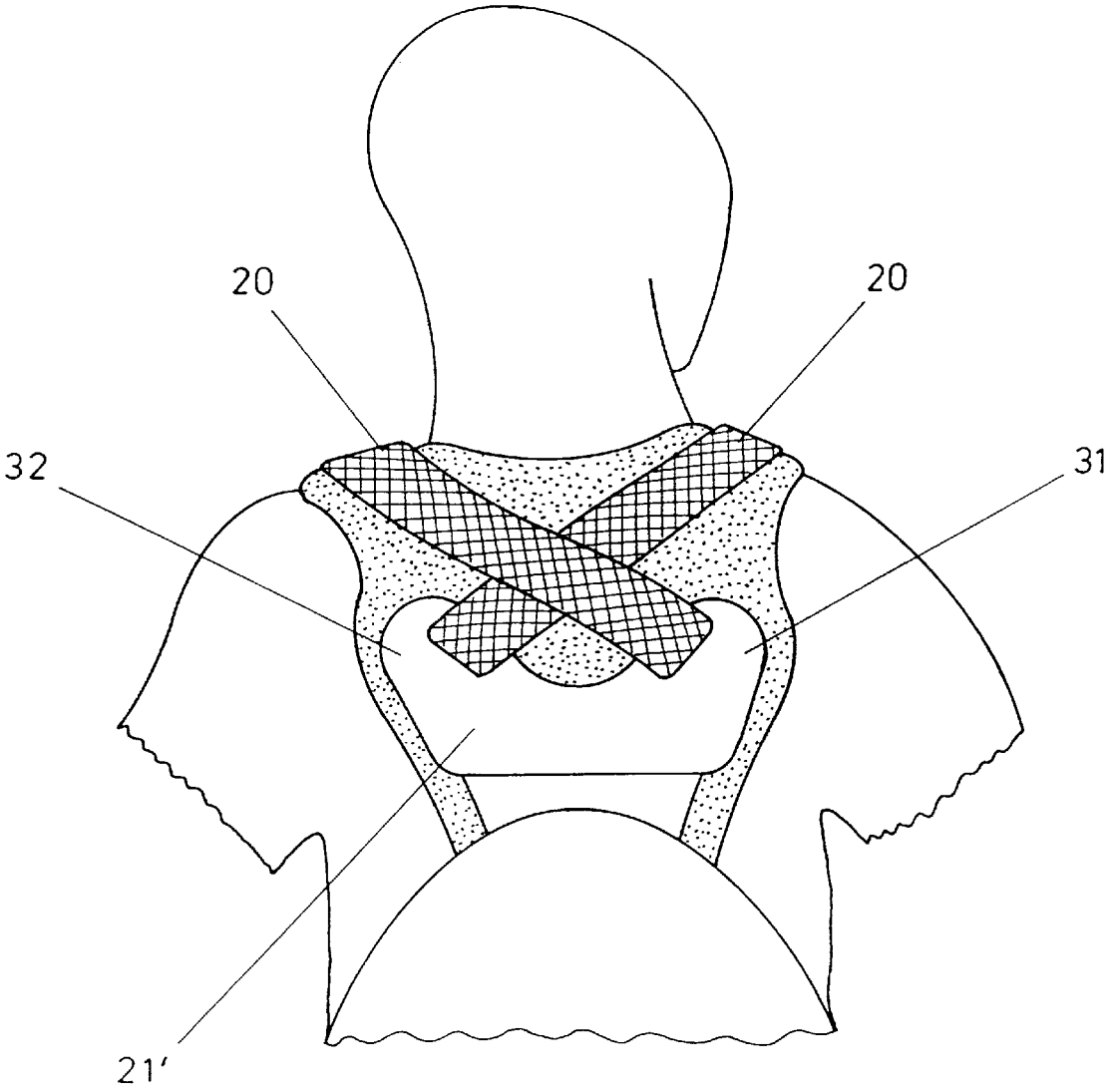
Figure 16:
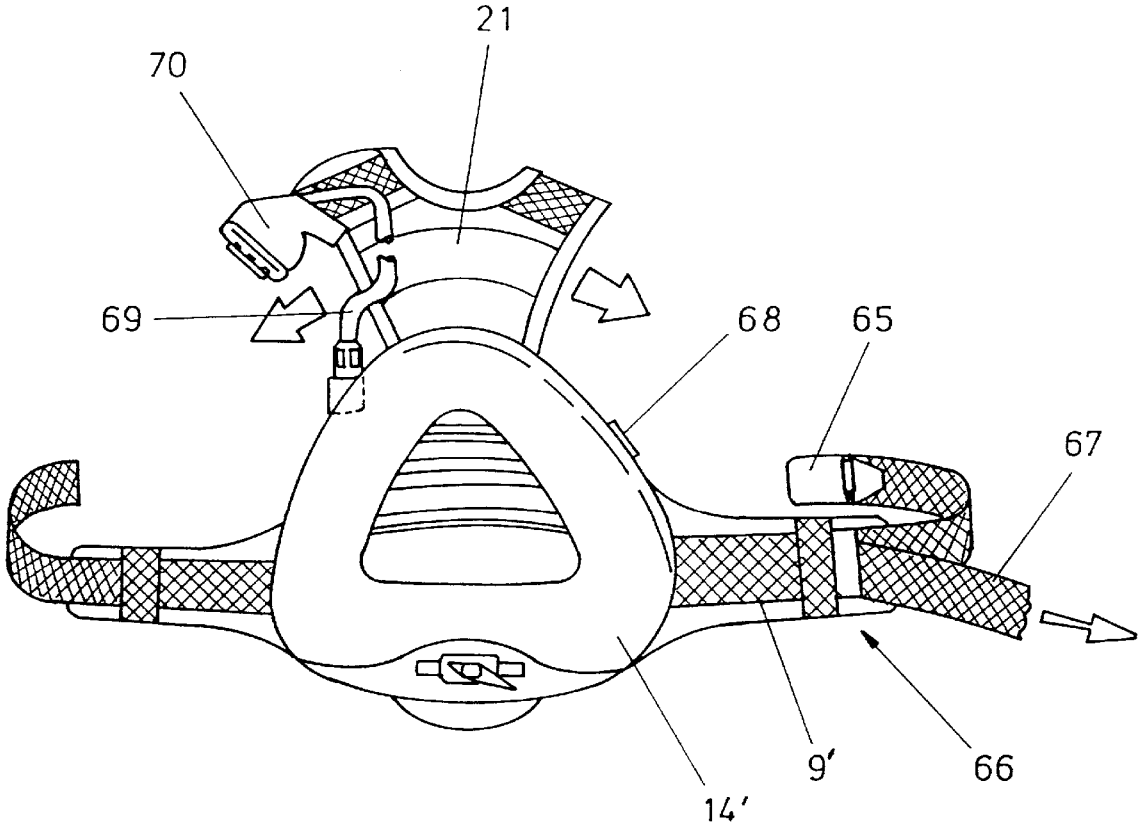
Figure 17:
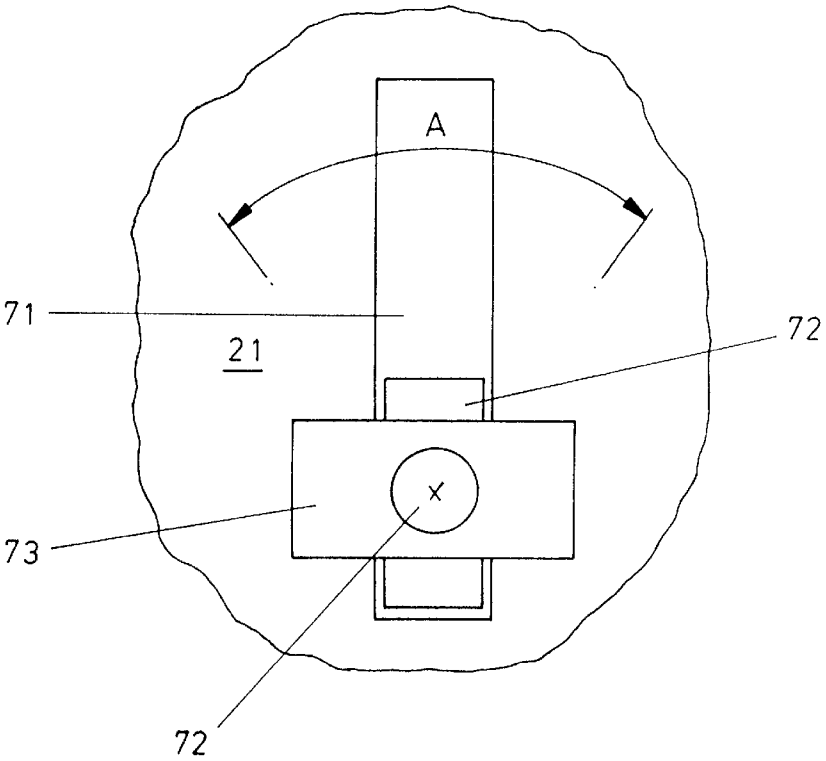
Figure 18:
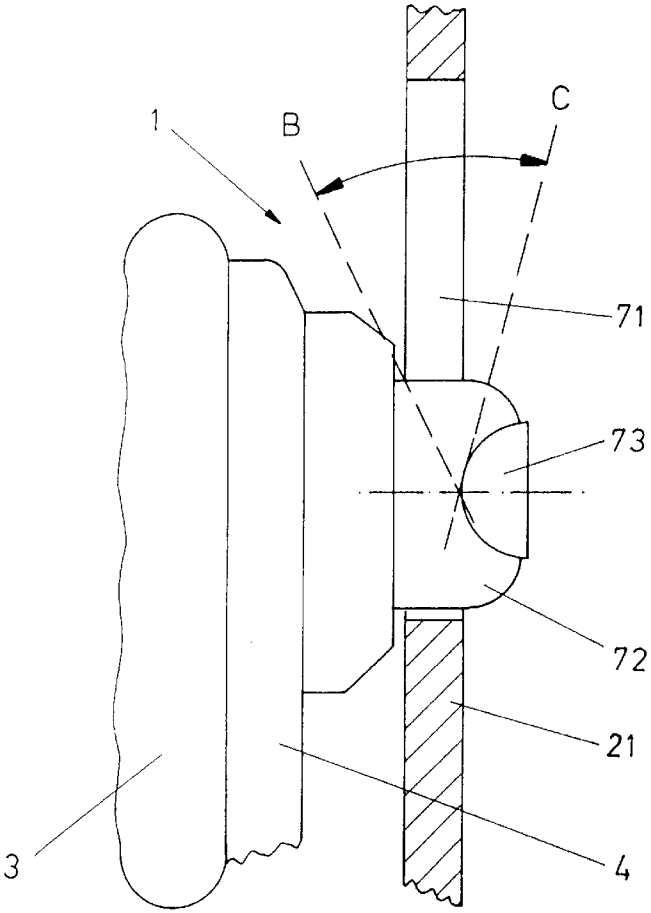
Figure 19:
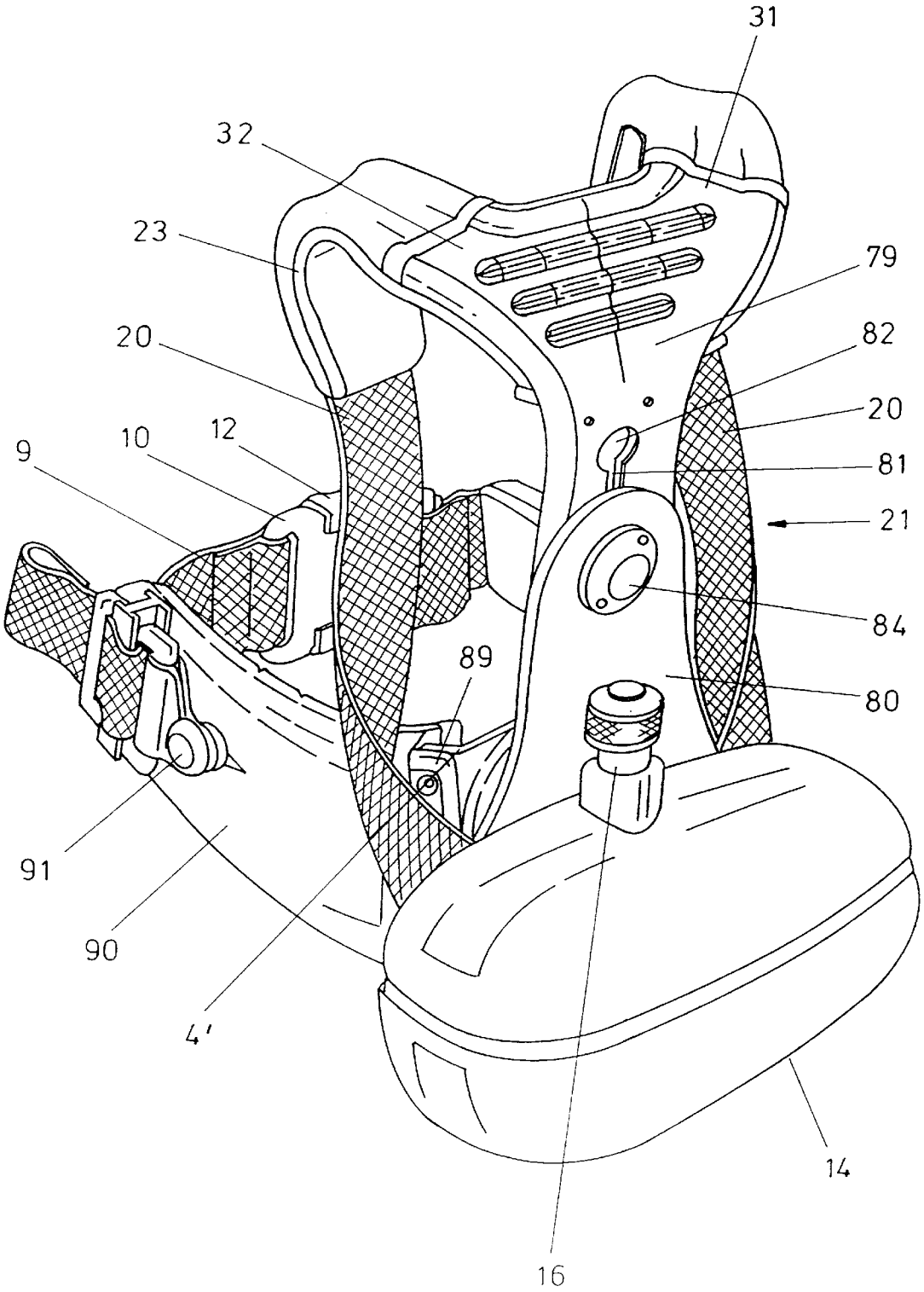
Figure 20:
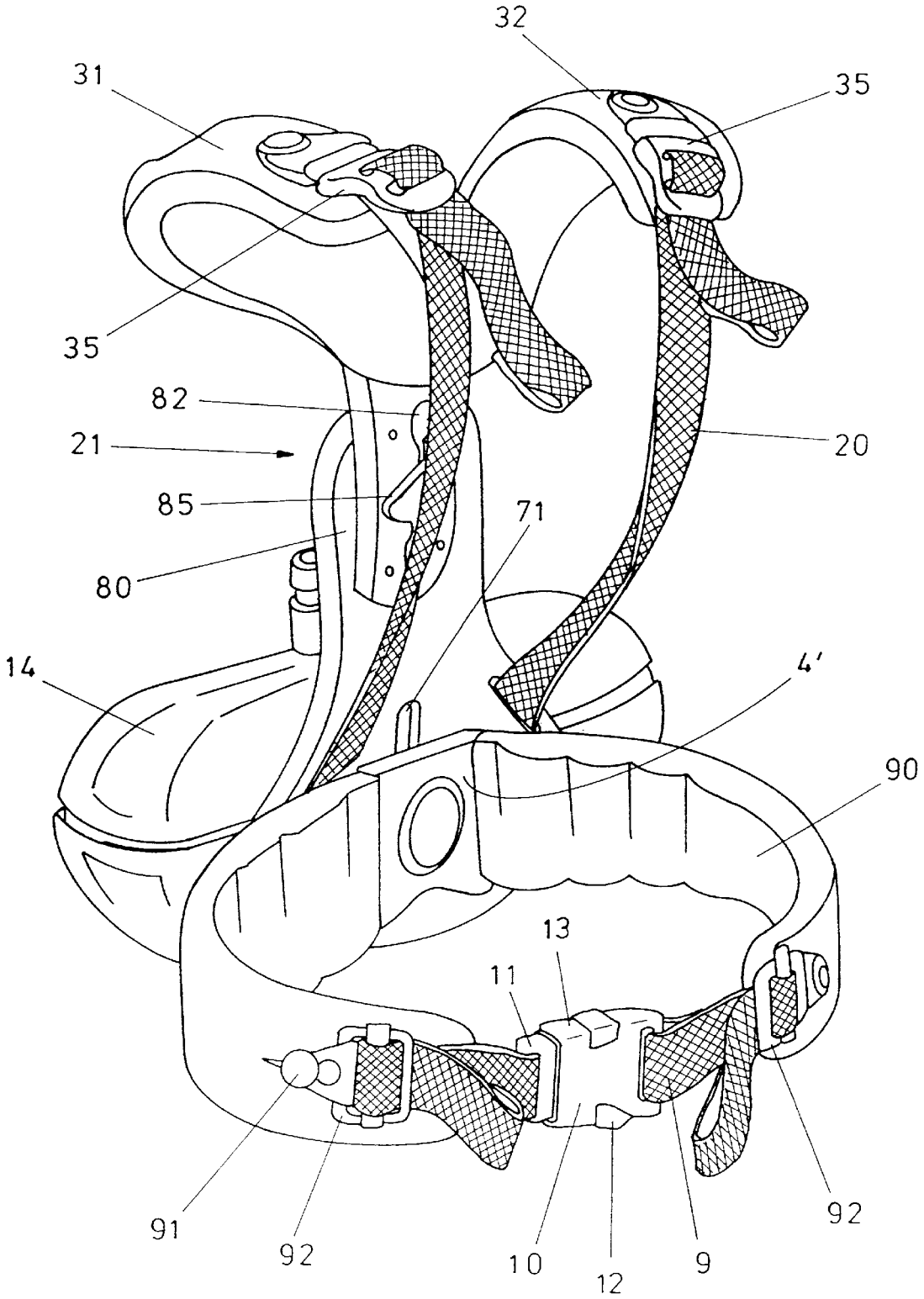
Figure 21:
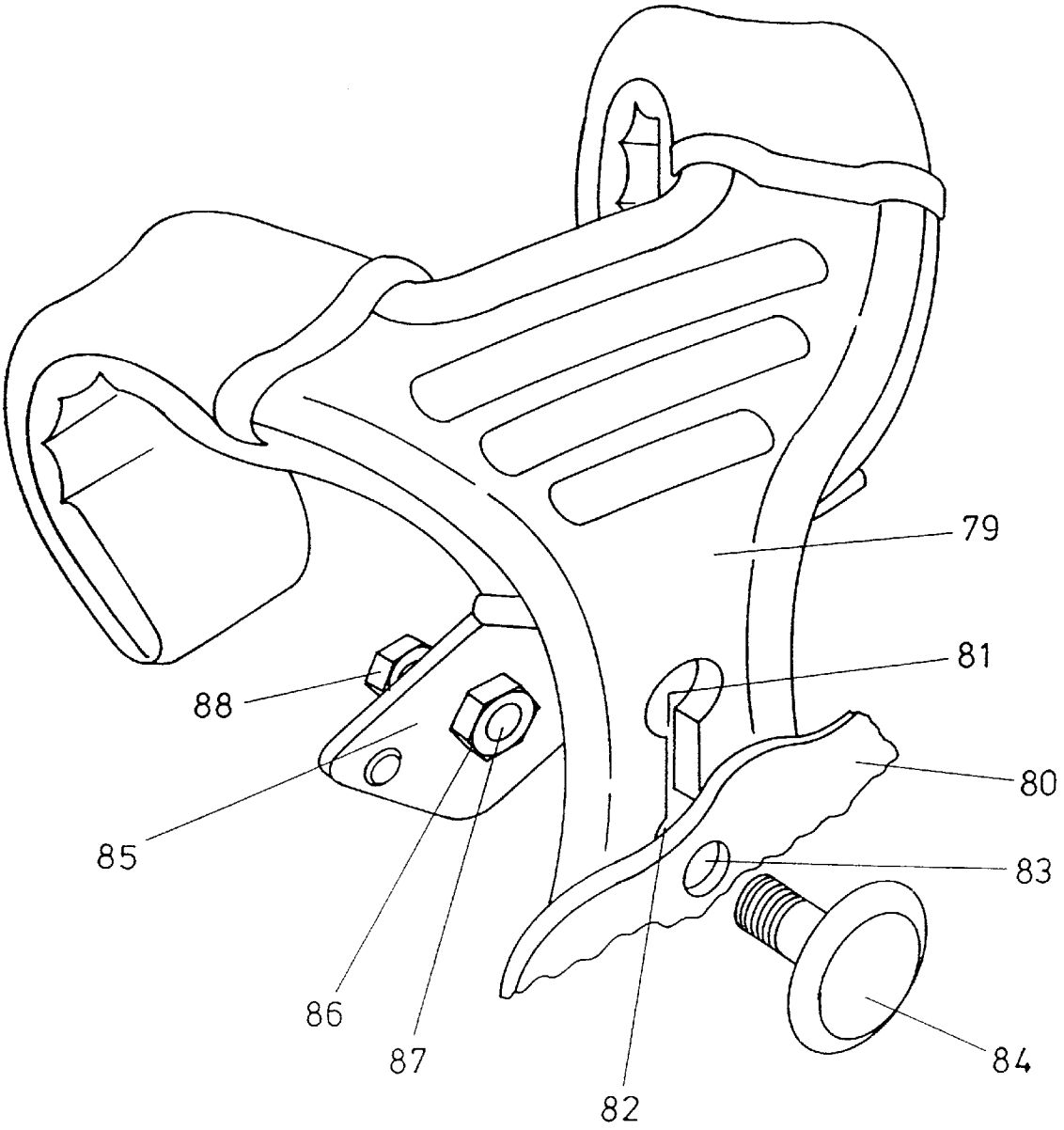
Figure 22:
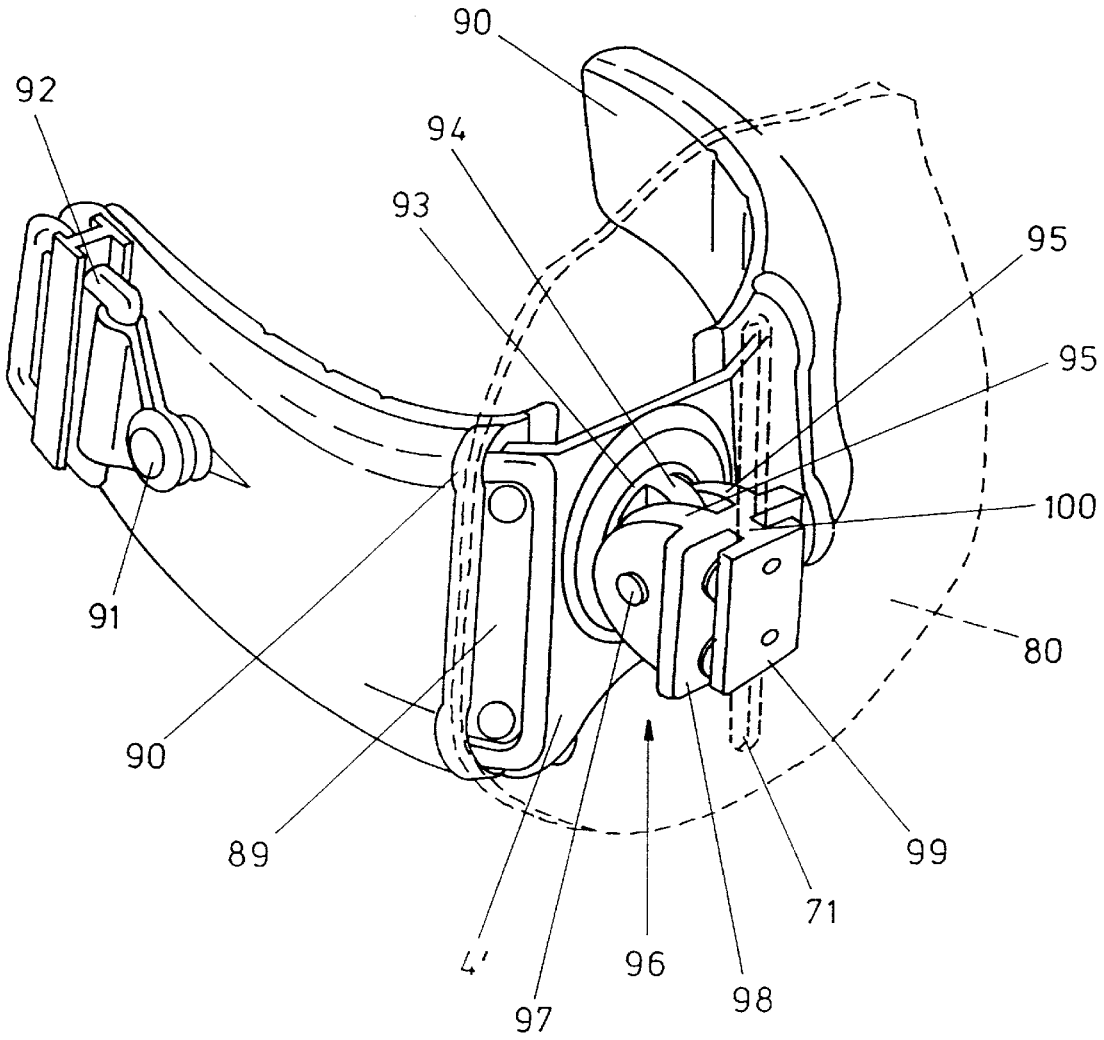
Figure 23:
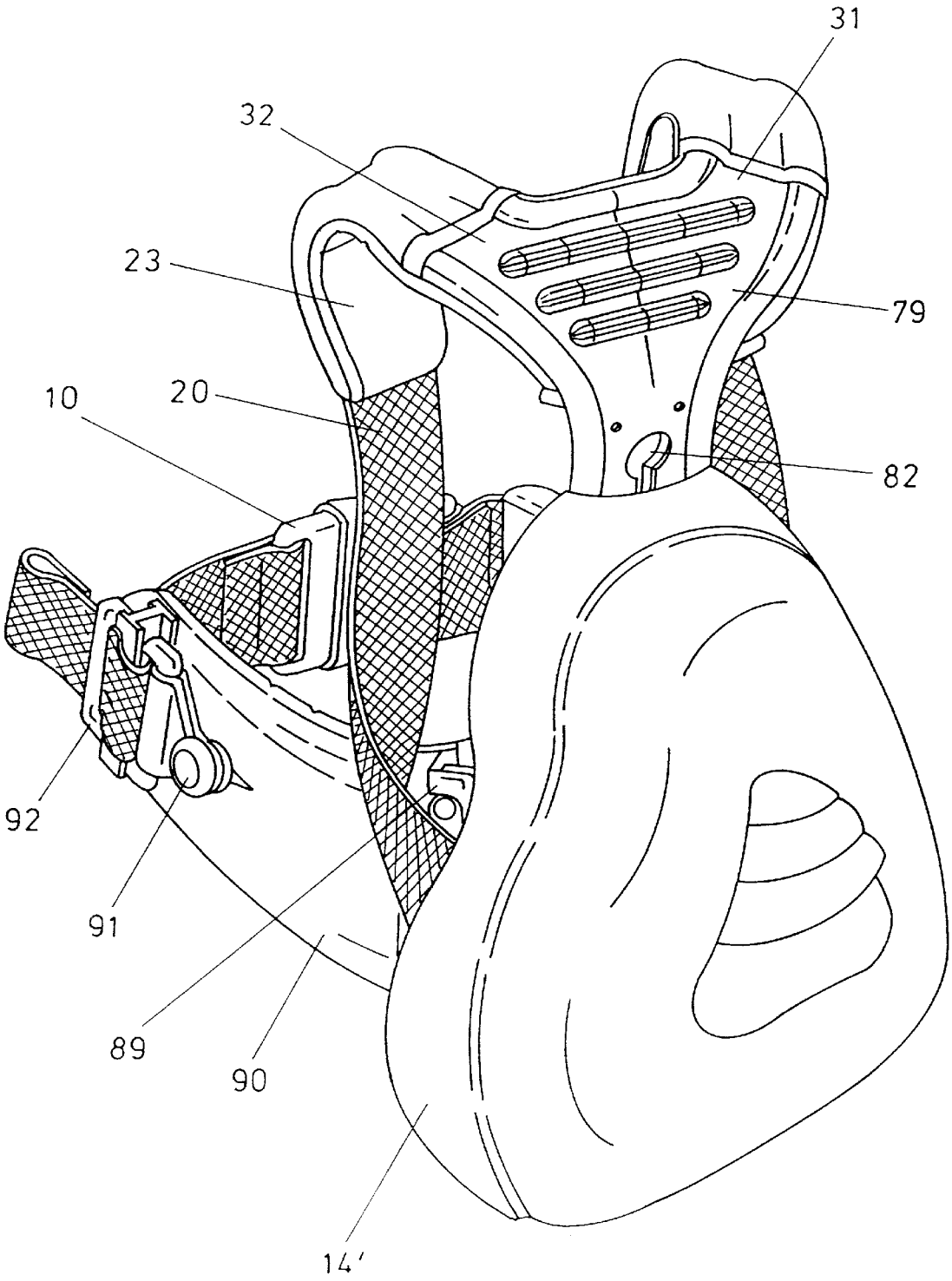
Figure 24:
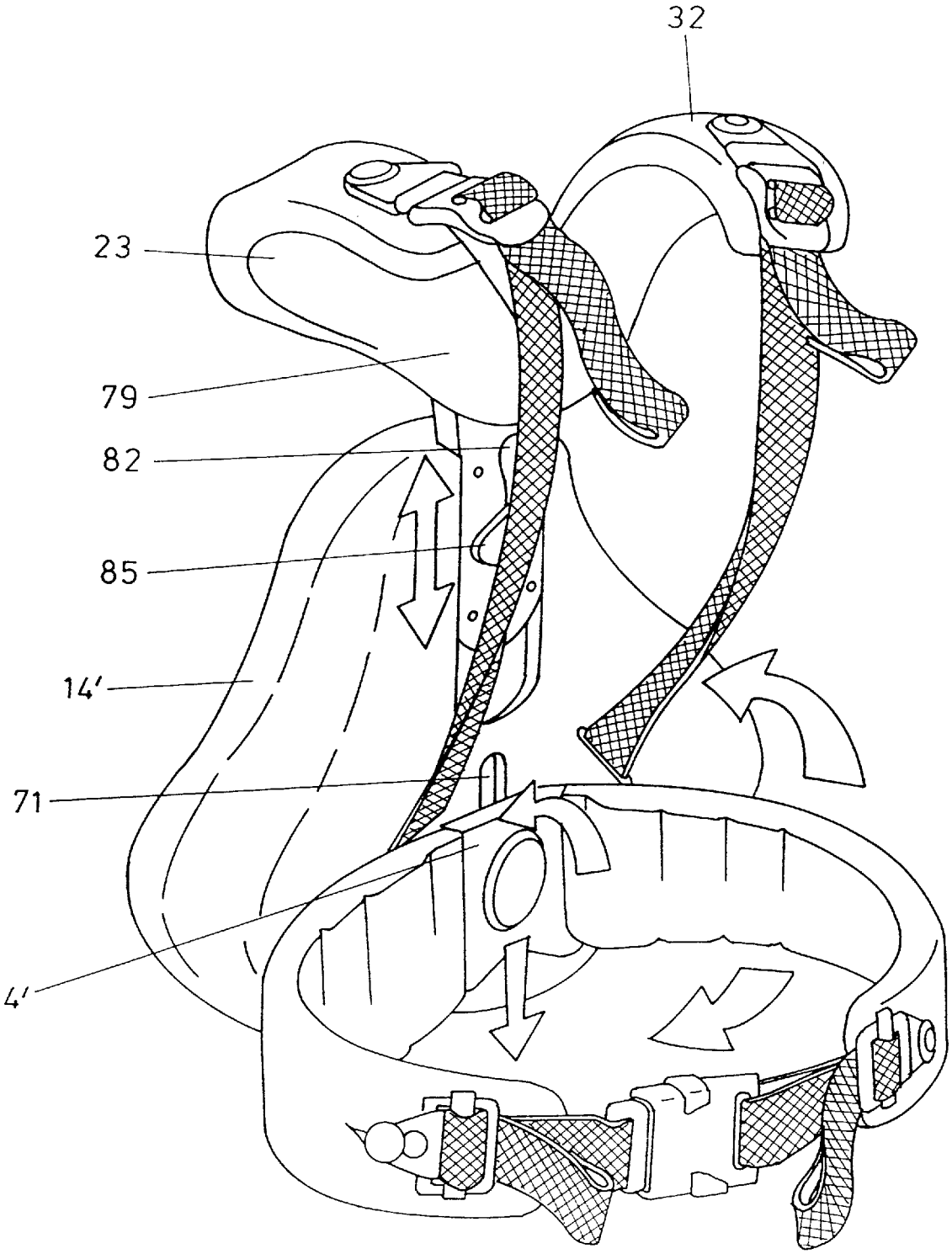
Figure 25:
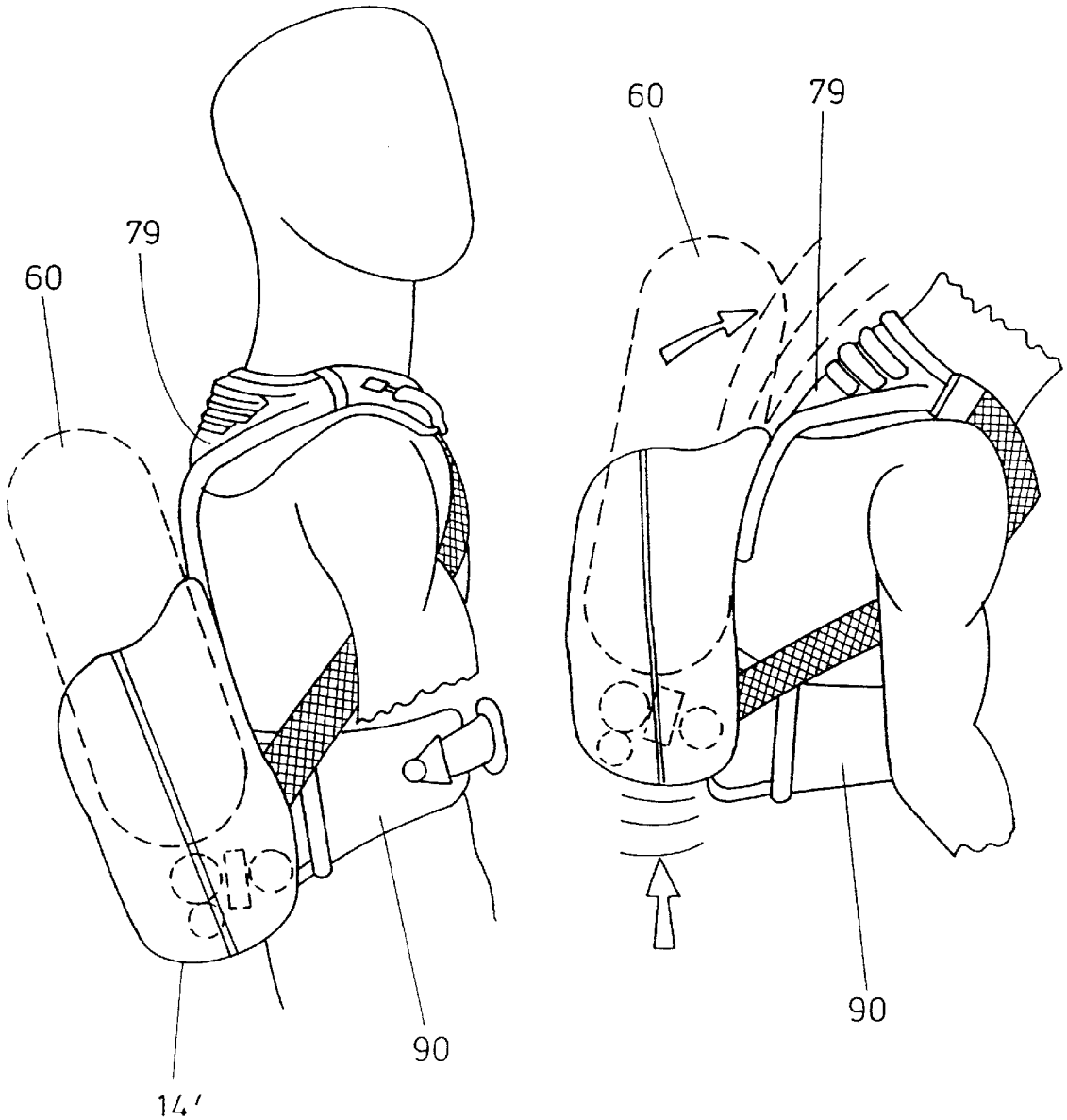
Figure 26:
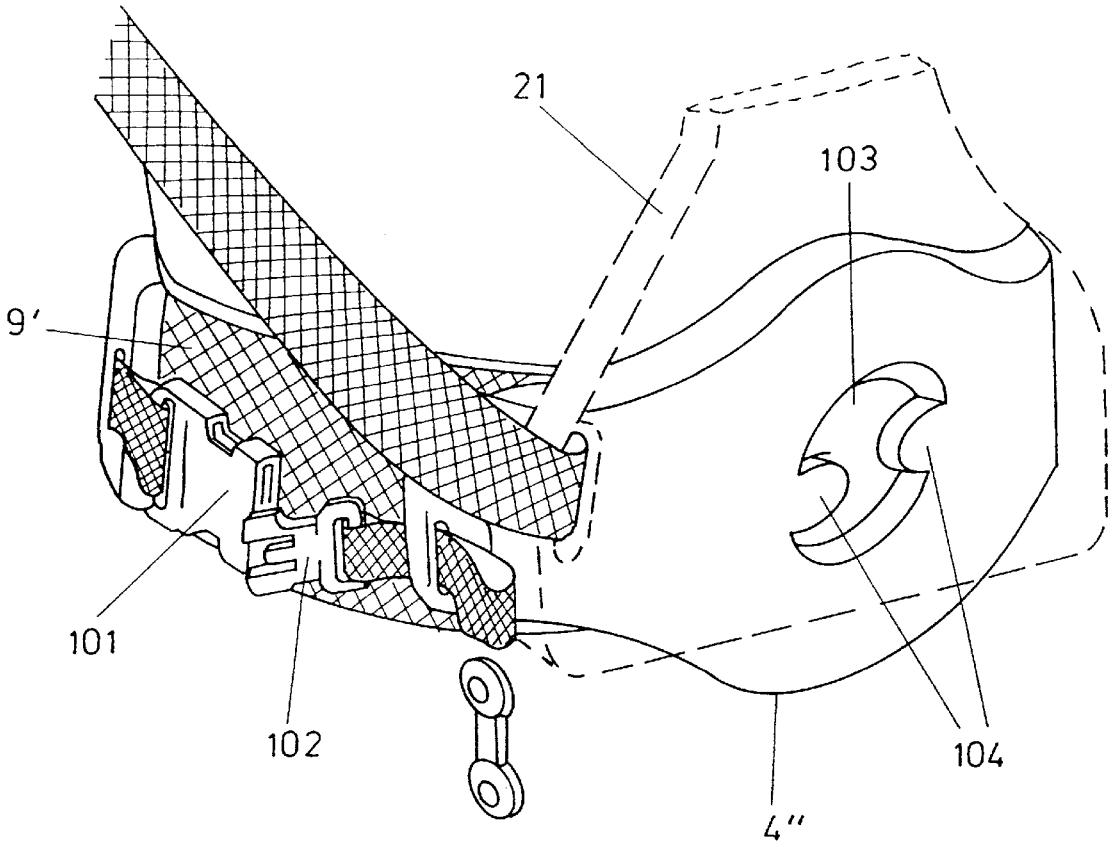
Figure 28:
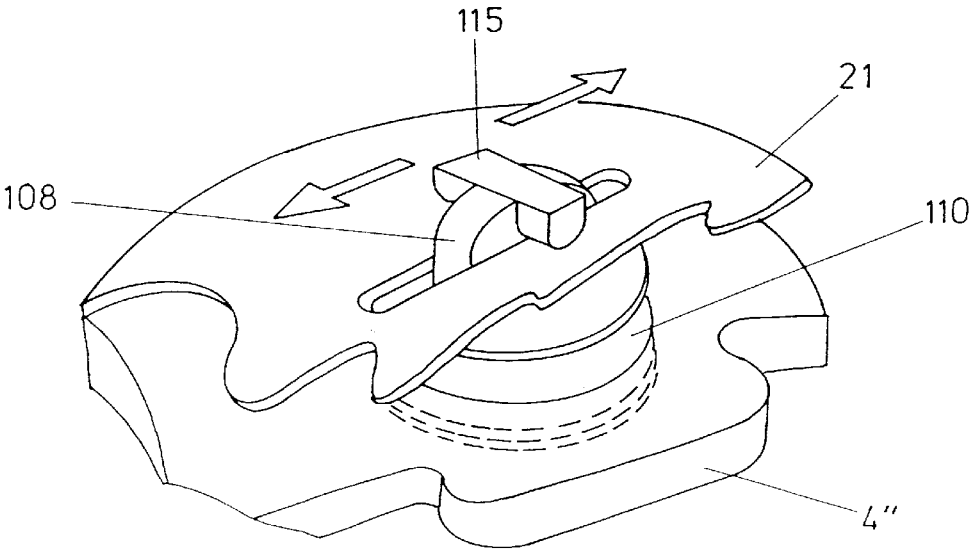
Figure 27:
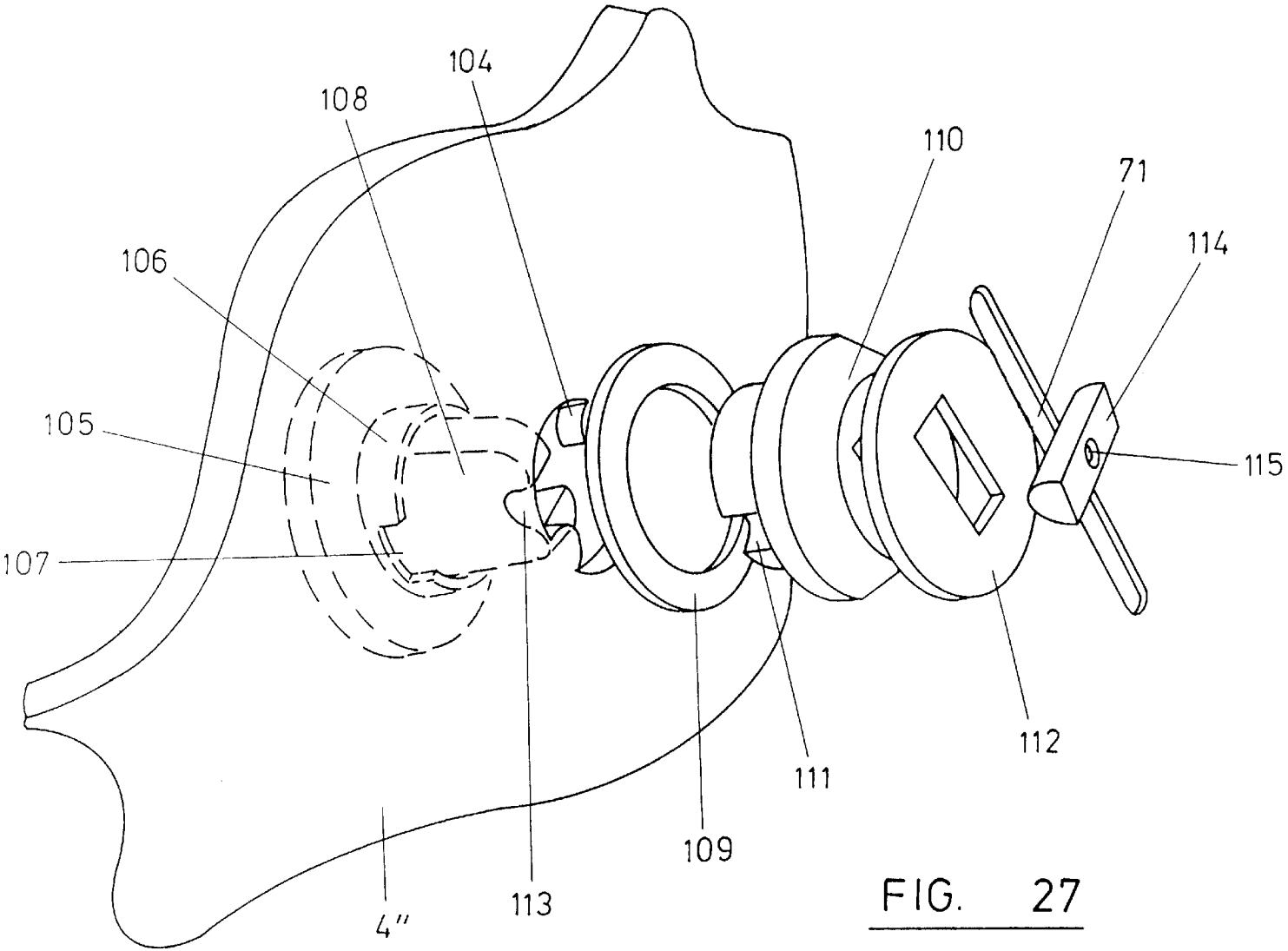

For a better understanding of the invention and to show how the same may be carried into effect, reference ill now be made, by way of example, to the accompanying drawings in which:

FIG. 1 shows a rear perspective view of a first embodiment of a harness for breathing apparatus in accordance with the present invention, FIG. 2 shows a front perspective view of the harness of FIG. 1, FIG. 3 is a rear perspective view of the back plate and a part of the waist plate of the harness of FIGS. 1 and 2, FIG. 4 shows an alternative form of a part of the harness shown in FIG. 3, FIG. 5 is a rear perspective view of a third embodiment of a harness for breathing apparatus in accordance with the present invention, FIG. 6 is a front view of the waist plate of the harness of FIG. 5, FIG. 7 is a cross section along line VII—VII of FIG. 6, FIG. 8 is a front view of a part of the breathing apparatus attached to the harness of FIG. 5, FIG. 9 is a front view of a part of the harness of FIG. 5, FIG. 10 is a rear perspective view of the harness of FIG. 5 in its folded away configuration, FIG. 11 shows a side view of the harness of FIG. 5 being worn by a wearer in an upright position, FIG. 12 corresponds to FIG. 11 and shows the harness with the wearer in a bending forward position, FIGS. 13 and 14 correspond to FIGS. 11 and 12 but illustrate the use of the harness with a different type of breathing apparatus, FIG. 15 shows a rear view of a fourth embodiment of a harness for breathing apparatus in accordance with the present invention, FIG. 16 shows a rear view of a fifth embodiment of a harness for breathing apparatus in accordance with the present invention, FIG. 17 is a schematic rear view of a part of a sixth embodiment of a harness for breathing apparatus in accordance with the present invention, FIG. 18 is a schematic partly sectioned side view of the embodiment of FIG. 17, FIG. 19 is a rear perspective view of a seventh embodiment of a harness for breathing apparatus in accordance with the present invention, FIG. 20 is a front perspective view of the harness of FIG. 19, FIG. 21 is a front perspective view of a part of the harness of FIG. 19, FIG. 22 is a rear perspective view of part of the harness of FIG. 19, FIG. 23 is a rear perspective view of an eighth embodiment of a harness for breathing apparatus in accordance with the present invention, FIG. 24 is a front perspective view of the harness of FIG. 23, FIG. 25 is a side view of the harness of FIGS. 23 and 24 being worn by a wearer in an upright position and in a bending forward position, FIG. 26 is a rear perspective view of a part of a ninth embodiment of a harness for breathing apparatus in accordance with the present invention, FIG. 27 is an exploded view of a part of the harness of FIG. 26, and FIG. 28 shows the part shown in FIG. 27 but in the non-exploded configuration.

In the drawings, corresponding parts are denoted by like reference numerals.

Referring now to FIGS. 1, 2 and 3, the harness comprises a waist plate 1 comprising a rigid supporting member 2 formed of plastics material (such as the linear polyamide known as nylon) faced with padding 3 formed of a resilient material such as foamed plastics material. The waist plate 1 is ergonomically shaped so as to provide lumbar support. More particularly it includes a back portion 4 for engaging the back of the wearer and side portions 5 and 6 at each end of the back portion for engaging the hips of the wearer. Each of the side portions 5 and 6 has a lip 7 and 8, respectively, at its upper edge for seating on the hip of the wearer.

A waist belt 9 formed of webbing is secured to the waist plate 1. The waist belt includes a connector comprising a female portion 10 at one of its free ends and a male portion 11 at the other of its free ends. The male portion 11 comprises two resilient projections which are capable of entering the female portion 10 as a consequence of being displaced towards one another. They include shoulders 12 which engage with abutments 13 on the female portion when the projections return to their non-displaced position when fully entered into the female portion and which retain the male portion within the female portion. A means (not shown) is provided to enable the length of the waist belt 9 to be adjusted.

The waist plate 1 includes an upstanding portion 22 also formed of rigid plastics material to which a back plate 21 is pivotally attached so that it can move with respect to the waist plate. More particularly it can pivot in a vertical plane laterally with respect to the general direction of movement of the wearer. The back plate 21 is supported by the back of the wearer in use and is faced with resilient material 23, (similar to material 3) to provide padding for the back and shoulders and includes a protrusion in the form of a boss 24 of circular section and carrying a groove 25 in its outer periphery. The upstanding portion 22 on the waist plate includes an aperture 26 of a dimension which will receive the boss 24. Located at opposite sides of the aperture 26 are clips 27 resiliently mounted within the aperture so that they are urged towards one another. When the boss 24 is introduced into the aperture 26 the clips 27 move apart from one another to allow passage of the boss 24 and then engage in the recess 25 under their resilient bias and retain the back plate 21 in position on the upstanding portion 22 in such a manner that the back plate 21 can pivot with respect to the portion 22.

In a variation of the above construction, the boss may be in the form of a protrusion 24' carrying a pair of diametrically opposed lugs 28 and the aperture 26' may include a pair of diametrically opposite recesses 29 as shown in FIG. 4. The recesses 29 are dimensioned to allow the protrusion 24' to pass through the aperture when the recesses 29 and lugs 28 are in register and then to retain the protrusion 24' within the aperture when the back plate 21 is suitably rotated with respect to the upstanding portion 22 so that the lugs 28 and recesses 29 are no longer in register.

Both the above constructions provide a means of quickly connecting the back plate 21 to the upstanding portion 22 in a manner which enables the back plate 21 to pivot with respect to the portion 22.

The back plate is height adjustable with respect to the waist plate as a consequence of the upstanding portion 22 including three of said apertures 26 (26'). Thus the back plate 21 may be connected to the waist plate by any of these apertures to allow for the harness to be worn by wearers of significantly differing height.

The back plate 21 includes a plurality of laterally extending thinner portions 30 whereby it is provided with some flexibility in the fore and aft direction with respect to the normal direction of motion of the wearer.

The back plate 21 is bifurcated at its upper end 79 and terminates in a first limb 31 and a second limb 32. A first shoulder strap 20 is secured to the first limb 31 at its first end and is provided at its second end with a loop 33 through which the waist belt 9 passes. A second shoulder strap 20 is similarly attached to the second limb 32. In this way, the first. ends of the shoulder straps 20 are maintained in their respective positions irrespective of movement of the wearer. Each shoulder strap 20 includes an adjustable buckle 35 (not shown in FIG. 1) whereby the height of the harness with respect to the wearer's back can be altered as desired.

The harness has secured thereto a durable rigid casing 14 carrying two substantially spherical containers 15 of composite material for holding breathing gas under pressure. The casing 14 is secured to the waist plate 1 in the manner shown in FIGS. 6, 7 and 8 described hereinafter. The containers 15 are each linked via a manifold (not shown) to a high pressure inlet 16 passing through an opening in the casing 14 for charging the containers with gas. Gas is taken from the containers 15 by means of a medium pressure outlet (not shown) connected to the manifold by means of a pressure reducer (not shown).

In use, the shoulder straps 20 are passed over the shoulders and the waist belt 9 is fitted around the back and sides of the wearer so that the lips 7 and 8 rest on the top of the hip bones of the wearer and the waist belt 9 is tightly secured about the waist of the wearer by means of the male and female connector portions, the length of the belt being adjusted as appropriate by the adjustment means (not shown). In this way, the harness is locked onto the wearer's waist and hips in a comfortable manner and allows negligible movement of the containers 15 with respect to the wearer.

Referring now to FIGS. 5, 6, 7 and 8 there is shown the harness of FIGS. 1, 2 and 3 arranged to secure to the wearer three substantially spherical containers 15 within a casing 14'. A connector plate 40 is secured to the waist plate 1 by means of spigots 41 adapted to pass through holes 42 and 43 in reinforcing plate 44 and waist plate 1, respectively, and through holes 45 in connector plate 40 to engage in bores 46 in studs 47 on connector plate 40. Four such studs 47 are provided and each has a domed head 48 of larger dimension than shank portion 49.

The casing 14' for the spherical containers 15 includes four apertures each comprising a slot 50 having a width greater than the diameter of the shank portion 49 but less than the diameter of the domed head 48 of the studs 47 and a circular portion 51 having a diameter greater than the diameter of the domed portion 48 of the studs 47. The apertures are provided on the casing 14' in such a manner that the circular portions 51 can be put in register with the four studs 47 on the connector plate 40 whereby the studs 46 can pass through the circular portions 50. Then by suitably rotating the casing 14' the shank portions 49 of the studs 47 are caused to pass along the slots 50 whereby the casing and the containers therein are securely attached to the connector plate 40 by the dome portions 48 of the studs 47. Thus, the casing can be quickly connected to the harness.

Referring now to FIGS. 9 and 10 it can be seen that, because or the pivotal mounting of the back plate 21, the harness can be readily folded away for storage or carrying purposes so as to adopt the configuration shown in FIG. 10 by pivoting the back plate 21 through about 180° with respect to the upstanding portion 22 of the waist plate.

Referring now to FIGS. 11 and 12, there is shown the harness and apparatus of FIG. 5 secured to the wearer.

The waist plate 1 is securely seated in the lumbar region of the wearer and the back plate 21 is held closely against the wearer's back and shoulders. FIG. 11 shows the harness and apparatus secured to the wearer in an upright position. As can be seen from FIG. 12, when the wearer leans forward, the back plate 21 can bend transversely at the thinner portions 30 to facilitate movement of the wearer.

FIGS. 13 and 14 are similar to FIGS. 11 and 12 but show the harness used for carrying pressurised breathing air in a generally cylindrical container 60 formed of carbon fibre composite material and having a capacity of 6.8 litres.

FIG. 15 shows another embodiment of the harness. In this case the back plate 21' is shortened so that it does not reach the shoulders and the shoulder straps 20 attached to limbs 31 and 32 cross one another before passing over the shoulders. In this way there is less tendency for the shoulder straps 20 to slip off the shoulders when the wearer moves from side to side.

Referring now to FIG. 16, there is shown another type of full harness used to carry three spherical containers (not shown) in a casing 14' This harness also includes a pivotally mounted back plate 21 having fore and aft flexibility and shoulder straps (not shown) and a waist belt 9'. The waist belt includes quick release connector 65 and a length adjusting mechanism 66 whereby it may be shortened by pulling on free end 67 in a manner known per se. The casing 14' includes a first opening 68 whereby all three containers may be charged with breathing gas under pressure via a high pressure inlet and a second opening by means of which one end of a hose 69 is connected to a medium pressure outlet of a reducing valve (not shown), the other end of the hose 69 terminating in a demand valve 70.

Referring now to the embodiment of FIGS. 17 and 18, the back plate 21 includes an aperture in the form of a narrow vertical slot 71 provided at its lower end. A protrusion in the form of a flexible boss 72, centrally mounted on the rear of the back portion 4 of the lumbar support waist plate 1, protrudes through the slot 71 and the back plate 21 is retained on the boss by the retaining member 73 having a length greater than the width of the slot 71. The back plate 21 can thus move vertically with respect to the waist plate 1 to vary the overall length of the waist plate 1 and back plate 21 as a consequence of relative displacement of the slot 71 and the boss 72. Also, the flexible nature of the boss 72 permits angular movement of the back plate 21 with respect to the waist plate 1.

When the waist belt to which the waist plate 1 is attached, is worn locked onto the hips of the wearer, the boss 72 will be located in the centre of the lumbar region. This permits multi-directional movement of the upper body, up to A° laterally (left or right), and fore and aft movement up to B° bending forward, and C° bending backwards. The shape and elasticity of the flexible boss 72 itself also permit rotational movements of the lower spine, whilst the weight load remains on the hips.

When the wearer is standing upright, the weight load on the back plate 21 asserts itself, by force of gravity, whereby the vertical slot 71 travels fully down the boss 72 until the majority of the weight being carried is transferred to the hips of the wearer via the boss 72, the lumbar support waist plate 1 and the waist belt to which it is attached.

Whenever the wearer leans forward, the spine elongates (stretches). If the wearer were wearing a harness comprising a back plate rigidly connected to a waist plate, this stretching of the spine would draw the back plate and the waist plate to which it is immovably attached, upwards. This means that the waist plate would ride up above the hips. As the wearer straightened up again the waist plate would be unable to relocate itself in its correct position. This in turn would mean that the weight load would therefore be higher up the wearer's back than it should be, and would be less stable because the shoulder straps would become loosened due to the raising of the waist plate. The wearer would therefore be at greater risk of physiological strain in attempting to control the less stable weight load. On the other hand, the harness shown in FIGS. 17 and 18 allows for the elongation of the spine. It allows the wearer to bend forwards and draw the weight load upwards as a consequence of the vertical slot 71 travelling smoothly up the boss 72 without pulling the waist plate off the hips. When the wearer stands upright again, the weight load reasserts itself through the force of gravity and the vertical slot travels smoothly down the boss until the top of the slot reaches the boss and transfers the weight load back onto the hips of the wearer via the waist plate and the lumbar support waist belt.

Referring now to FIGS. 19 to 22, in this embodiment, the back plate is secured to the waist plate in a manner generally similar to that shown in FIGS. 17 and 18 and, moreover, the back plate is in two parts to facilitate height adjustment. The back plate 21 includes an intermediate part 80 linking the upper end part 79 comprising limbs 31 and 32 with the waist plate 4'. The upper end 79 is moveably connected to the intermediate part and includes an elongated vertical slot 81 terminating in a circular aperture 82 at each end. The adjacent end of intermediate part 80 includes an aperture 83 to receive a securing bolt 84 having a shank of a dimension such that it can protrude through elongated slot 81. A washer 85 having a projection 86 including a bore 87 is provided to receive the shank of the bolt 84 protruding through intermediate part 80 and the upper end 79. The washer 85 is retained on the shank by a nut 88. The shape of the projection 86 is such that one of its dimensions is less than the width of the slot 81 and its dimension at right angles to said dimension is greater than the width of slot 81 but less than the diameter of aperture 82. Thus, by slightly slackening nut 88 and appropriately rotating washer 85, the bolt 84 can be slid along slot 81 and then retained in either of apertures 82 by appropriately rotating the washer 85 again before tightening the nut 88. In this way, the overall length of the back plate 21 and the waist plate 4' can be varied in order to accommodate wearers of different height.

The waist plate 4' is secured, at its lateral edges, to a wing 89 of plastics material encased in a padded pocket 90 forming the side portions of the waist plate for engaging the hips of the wearer. In this embodiment, the waist plate 4' is spaced from the back of the wearer in use because of the padded pockets 90. The wings 89 are able to flex in a transverse direction so as to envelop the wearer,s hips but are otherwise resistant to flexing. A waist belt 9 including male and female connectors 10 and 11 is secured at its ends to the wings 89 by bolts 91. The waist belt 9 includes length adjusting members 92 at each end.

The intermediate part 80 of the back plate 21 is secured to the waist plate 4' by a mechanism allowing articulation between the intermediate part 80 and the waist plate 4'. More particularly as shown in FIG. 22 the rear of the waist plate 4' has a member 93 mounted thereon so that it can rotate about an axis normal to the waist plate 4'. The member 93 includes an upstanding flange 94 which is received between a pair of flanges 95 of a connecting member 96. A bolt 97 passes through the flanges 94 and 95 to secure the members 93 and 96 together in a manner such that the member 96 can pivot about the longitudinal axis of the bolt 97. The member 96 includes a first plate member 98 spaced from a second plate member 99 by a distance somewhat greater than the thickness of the intermediate part 80 (shown by dotted lines in FIG. 22 for the purpose of clarity) of the back plate 21 by means of a web 100 such that the first plate member 98 is located at one side of the intermediate part 80 and the second plate member 99 is located at the other side of the intermediate part 80 with the web 100 protruding through the slot 71 in the intermediate part 80. Thus, the intermediate part 80 and the remainder of the back plate 21 are able to move vertically with respect to the waist plate 4' and the waist belt associated thereto by virtue of the web 100 and the slot 71 being relatively axially displaceable. In this way the overall length of the waist plate and back plate can vary in use to accommodate the movement of the wearer as previously described. Further, the intermediate plate 80 and the upper end 79 of the back plate 21 can together pivot towards and away from the waist plate 4' by virtue of the movement of the connecting member 96 about the longitudinal axis of bolt 97 Moreover, the intermediate part 80 and the caper end 79 can together rotate about an axis normal to the waist plate 4' by virtue of the rotational mounting of the member 93 on the waist plate 4'.

Referring now to FIG. 23, this is essentially identical to the previous embodiment except that, in this case, the harness includes a casing 14' accommodating three substantially spherical gas containers in the manner illustrated in the embodiment of FIG. 5 and, moreover, the upper end of the casing serves as the intermediate part of the back plate linking the upper end 79 of the back plate to the waist plate 4'. Thus, the slot 71 is, in this case, provided in the casing 14' and the upper end 79 of the back plate is mounted on the upper end of the casing 14' in a similar manner to the way in which the upper end 79 in the embodiment of FIGS. 19, 20, 21 and 22 is secured to the intermediate part 80 so that it is possible to adjust the overall length of the waist plate and back plate to accommodate wearers of different height. FIG. 24 shows, by the large arrows, the manner in which the upper end 79 may move with respect to the casing 14' to accommodate different wearers and the manner in which the casing 14' may move with respect to the waist plate 4' as a conseguence of the manner in which it is mounted thereto as previously described. The relative movement of the upper end 79 and the intermediate part 80 and the relative movement of part 80 and the waist plate 4' in the embodiment of FIGS. 19 to 22 is similar.

Referring now to FIG. 25, this shows the embodiment of FIGS. 23 and 24 when being worn. The drawing to the left shows the disposition of the apparatus when the wearer is in an upright position and the drawing to the right shows the disposition when the wearer is leaning forward. As can be seen, as the wearer leans forward, the back plate constituted by the upper end 79 and the casing 14' can move upwards with respect to the waist plate and waist belt which remain in position around the wearer's waist. The upper end 79 also flexes forward. The movement of the back plate and the upper end 79 is indicated by the arrows.

The same situation applies in the case where a conventional cylindrical gas container 60 is used (as shown by the dotted lines) instead of the spherical containers within casing 14'.

Referring now to FIGS. 26 to 28, these illustrate the invention wherein the harness is incorporated in a firefighters safety belt of the DIN type. As shown, the safety belt 9' fits around the waist of the wearer and includes a quick release connector part 101 whereby a waist plate and back plate assembly in accordance with the instant invention can be readily clipped thereto by means of a corresponding connector part 102. The waist plate 4" is relatively rigid and formed of, for example, plastics material and includes an aperture 103 passing therethrough. The aperture is generally circular in section but includes a pair of diametrically opposed lugs 104. The aperture 103 is provided to receive a connecting assembly whereby the back plate 21 (not shown in FIG. 27 and shown in dotted lines only in FIG. 26 in the interests of clarity) including the longitudinal slot 71 may be secured thereto. The assembly comprises a stud having a flange portion 105 to prevent the stud being pulled through the aperture 103 and a cylindrical portion 106 arranged to pass through the aperture 104. The cylindrical portion 106 includes cutouts 107 to receive the lugs 104. The stud includes a projecting portion 108 which protrudes through the slot 71 in the back plate 21. A metal washer 109 fits over the cylindrical portion 106 after it has passed through the aperture 104 in the waist plate 4" and receives a rubber buffer 110 including cutouts 111 to accommodate the lugs 104. The projecting portion 108 passes through the rubber buffer and through a second metal washer 112 before passing through the slot 71 in the back plate 21. The tip of the projection 108 includes a semi-cylindrical recess 113 and a semicylindrical retaining member 114 is located within this recess and secured to the projection 108 by means of a screw 115 after the projection 108 has passed through the slot 71. In this way, the back plate 21 is firmly secured to the waist plate 4" yet it can execute a rocking motion with respect to the waist plate 4" as a consequence of the buffer 110 incorporated in the connecting assembly and, moreover, as shown by the arrows in FIG. 28, it can move up and down with respect to the waist plate 4" in order to accommodate movement of the wearer as previously described.

We claim:

1. A harness for securing breathing apparatus to the wearer of the harness, which harness comprises:

(i) a waist plate having a back portion and side portions, at each end of the back portion, for engaging the hips of the wearer, (ii) a waist belt, secured to the waist plate, for fastening around the waist of the wearer to hold the waist plate in position, (iii) a back plate mounted on the waist plate, (iv) shoulder straps for looping around the shoulders of the wearer and connected to the back plate, and (v) a means of securing said article to the harness, wherein one of the plates includes a portion defining an aperture in the form of a slot and the other of the plates includes a protrusion retained in the aperture to permit pivotal movement of the back plate in a plane generally parallel to the wearer's back so that it can pivot laterally with respect to the wearer, the protrusion being displaceable along the slot to accommodate longitudinal movement of the spine of the wearer during use.

2. A harness as claimed in claim 1, wherein a portion of the back plate is flexible in a fore and aft direction with respect to the normal direction of motion of the wearer.

3. A harness as claimed in claim 1 wherein said back plate includes an upper end which is bifurcated to form first and second limbs and an intermediate part linking the upper end to the waist plate wherein:

one end of a first of the shoulder straps is secured to the first limb and one end of a second of the shoulder straps is secured to the second limb, said slot is provided in said intermediate part, and said upper end is moveably connected to said intermediate part.

4. A harness as claimed in claim 3 wherein said upper end includes at least one additional aperture-defining portion defining an additional aperture and is moveably connected to said intermediate part by means of another protrusion passing through said additional aperture.

5. A harness as claimed in claim 4 wherein said upper end includes two of said additional apertures and said at least one additional aperture defining portion defines another slot linking the additional apertures.

6. A harness as claimed in claim 5 which includes a casing to accommodate said article and said intermediate part is constituted by a part of said casing.

* * * * *